United States Patent [19]

Miraglia, Jr.

[11] Patent Number: 5,026,071

[45] Date of Patent: Jun. 25, 1991

[54] WORD GAME

[76] Inventor: Humbert G. Miraglia, Jr., 1409 North St., Corning, Calif. 96021

[21] Appl. No.: 487,873

[22] Filed: Mar. 5, 1990

[51] Int. Cl.[5] ..... A63F 3/00

[52] U.S. Cl. ..... 273/272; 273/282; 273/299; 273/243; 434/160

[58] Field of Search ..... 273/236, 267, 272, 276, 273/281, 282, 299; 434/159, 160, 167, 168

[56] References Cited

U.S. PATENT DOCUMENTS

| | | | |
|---|---|---|---|
| 2,280,609 | 4/1942 | Williamson | 273/282 XR |
| 3,426,452 | 2/1969 | Kerr III et al. . | |
| 4,032,151 | 6/1977 | Morse | 273/282 XR |
| 4,243,225 | 1/1981 | Levinrad . | |

FOREIGN PATENT DOCUMENTS

| | | | |
|---|---|---|---|
| 608350 | 9/1948 | United Kingdom | 434/160 |

*Primary Examiner*—Edward M. Coven
*Assistant Examiner*—William M. Pierce

[57] ABSTRACT

A board game has an adherent playing surface for players to competitively develop words from individual alphabetical letters formed by placing removable strips on ordered matrix patterns incorporated onto the surface of the board. A die having opposite surfaces embossed with duplicate numbers of dots producing random totals of 1, 2, and 3 when thrown generate numerical information effecting player-agreed use options for disposition of the strips relative to the matrix patterns and for advancing the game to a win conclusion. The word game according to the invention is primarily a board game, but would be suitable as a computer game programmed on a disc or cartridge useful with computer graphics.

6 Claims, 2 Drawing Sheets

WORD GAME

BACKGROUND OF THE INVENTION

1. Field of the Invention

This invention relates to board games in general and more particularly to a game where words, letters or portions thereof are formed with removable markers on ordered matrix patterns incorporated onto the surface of the board.

2. Description of the Prior Art

Board games forming letters and words are well known in the past art. The majority of the games maneuver individually lettered tiles into words such as in the well known board game of "Scrabble". The tiles drawn or alloted to each player are generally not of the players choice and he must create words or phrases using randomly distributed letters. The player is often left at some point in the game with letters that are difficult or impossible to create words from. Many other games use the same random letter distribution method with various alterations of the rules and regulations of the game. Games of this type leave the player without the option to create words completely of his or her own choice. A search was conducted at the United States Patent Office to examine word oriented board games in general and specifically games in which the player generates the letters of self-chosen words by combination of segments. Of those past art patents examined, the following were considered most pertinent to my invention:

On Jan. 6, 1981, Maxim D. Levinrad was granted U.S. Pat. No. 4,243,225, for a game where portions of letters are combined to form complete letters, and the complete letters later used to form words. Each player is alloted a certain number of tiles not of his choice and is limited to creating letters within the range of the alloted tile group.

H. H. Kerr III et al, was issued U.S. Pat. No. 3,426,452, on Feb. 11, 1969, for an educational toy adapted for use in playing word games. Frameworks are used to build individual letters from separate geometric segments. Many of the frameworks are specific for certain letters or groups of letters and are therefore not versatile for all letters of the alphabet. The game board also does not contain an ordered matrix pattern used for forming the letters.

The foregoing were considered typical of developing past art relative to the field of the immediate invention. Neither of these past art patents were structured similar to my device nor were the playing objectives the same. I therefore feel that the individual letter structuring used in my word game provides new and novel features to the field of word games which are not included in the past art.

SUMMARY OF THE INVENTION

In practicing my invention, I have provided a game board with a flat horizontal playing surface having ordered matrix patterns aligned on the surface. The matrix patterns are all alike and are produced by a series of connecting lines forming triangle shapes and bordering lines which provide guidance for structuring letters of a specified alphabet, in this application, English. A longitudinal bisecting line crossing the center of the matrix pattern from a left hand upper corner to a right hand lower corner of the rectangular outline extends past the bottom straight line boarder a short distance.

This extended line is for alphabetical letters which may require digital parts formed below the main matrix pattern. A plurality of elongated uniform marker strips sized to fit at least a half portion of any of the lines are provided to the players with which to form individual alphabetical letters by positioning the strips strategically along the lines in the matrix patterns. Materials such as felt which tend to cling together are used on the playing surface of the game board and on the underside of the letter strips. The clinging materials keep the letter strips positioned along the lines on the playing surface of the game board where they are placed by the players.

The object of the game is to first form individual alphabetical letters and with these letters develop a complete word. Points are alloted for each word formed. A die is used for randomly generating numerical information effecting player-agreed use options for disposition of the letter strips relative to the matrix patterns and for advancing the game to an eventual win conclusion. The die is limited to a 1, a 2, or a 3 roll as the game die is special for this game having only these three numerical producing spots oppositely embossed in the die surfaces. A game board is provided for each player having four or five ordered matrix patterns printed onto the surface. The players agree on how many of the matrix patterns are to be used in each game. Less skilled and younger players may use as few as two matrix patterns while the more skilled players might use five. Four matrix patterns will normally provide optimum enjoyment for the average player.

The number of letter strips alloted each player is determined by a roll of a die. Each player has the option to create any letter he chooses or to change letters during the game, depending on the roll of the die. Each completed letter is given a number value of one, and the player to create the first completed word is allowed to total the number of letters. The player attaining a score of 32 or having the highest score at the end of a designated time period wins the game.

This game is simple to play since the rules are uncomplicated and the players can designate the number of letters each word will have. There are no complicated rules and regulations to follow which clutter up most letter structuring games, making those other games uninteresting to younger players.

Therefore a principal object of the present invention is to provide simple individual alphabetical letter structuring by attaching small letter strips onto guide lines in matrix patterns on a playing board and to form words from the developed letters.

Another object of the invention is to provide matrix patterns comprised of crossed lines producing triangular patterns in rectangular formations on a playing surface to which strips can be attached to create any letter of the alphabet.

A further object of my invention is to incorporate a letter-forming matrix patterned game board into an interesting alphabetical letter producing and word-forming game with uncomplicated rules combining learning and fun for both older and younger participants.

Other objects and the many advantages of the present invention will become clear by reading descriptions of numbered parts of the word game according to the invention in the specification and subsequent comparison of the described numbered parts with like numbered parts illustrated in the accompanying drawings.

DESCRIPTION OF THE PREFERRED EMBODIMENTS

Figures 1, 2, 3:
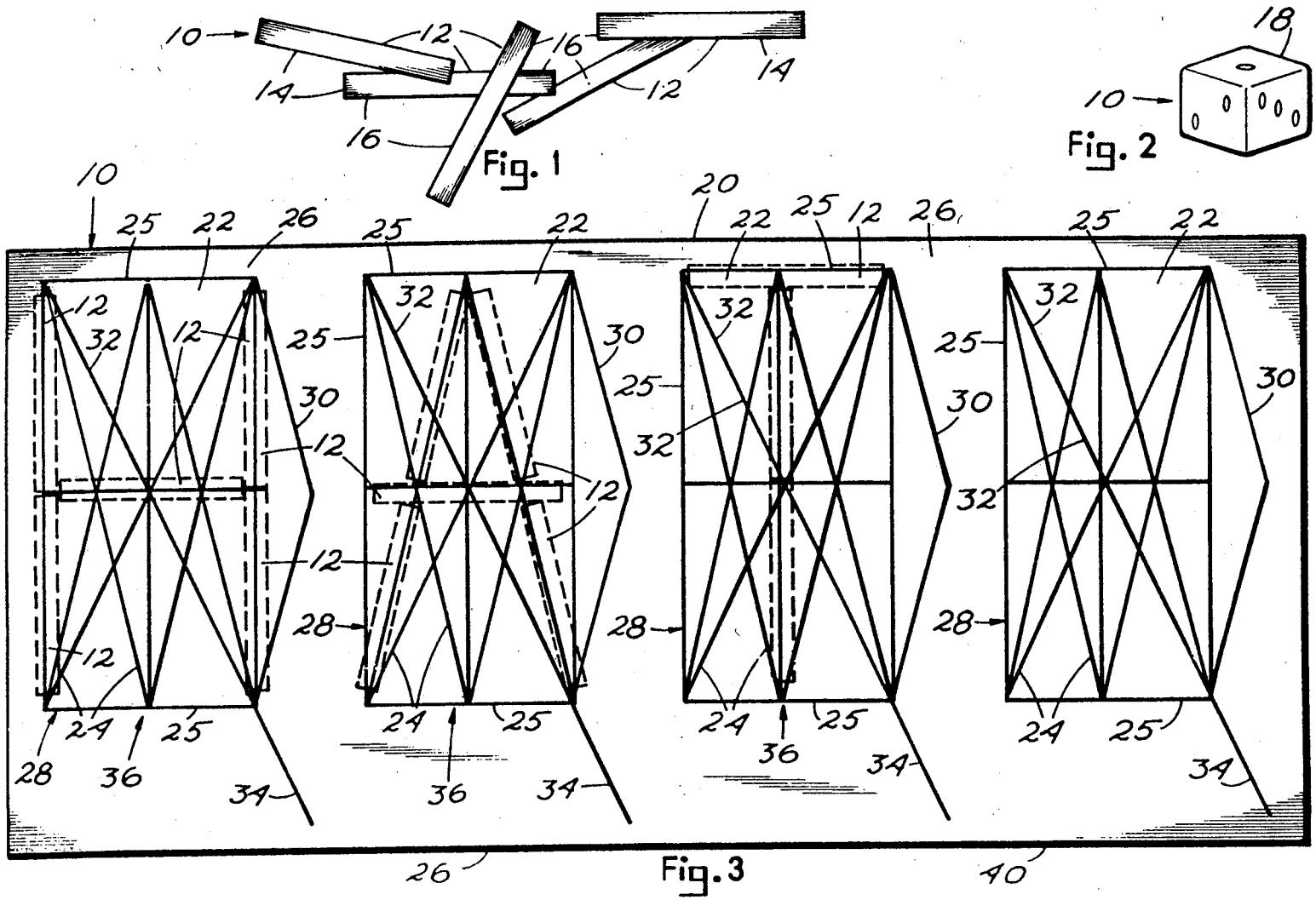
FIG. 1 illustrates a number of substantially rectangular felt backed letter strips used to form the individual alphabetical letters in the word game according to the invention. The number of letter strips shown are for illustration only as players are not restricted to any particular number of letter strips and the strips are allotted according to the throw of a die.
FIG. 2 shows the special die used in this word game. The die is limited to a 1, a 2, or a 3 roll by the dot patterns embossed in the die facings.
FIG. 3 illustrates a four-matrix game board for use in this word game invention. The game board shown is for illustration only as no limit is imposed on the number of matrix patterns on a particular board. Three alphabetical letters H, A, and T have been produced by placing letter strips on the matrix pattern, illustrated by dotted lines, and the word "HAT" has been developed.

Referring now to the drawings and particularly to FIGS. 1, 2, and 3 which illustrate elements of the invention with any element which is part of the game being designated word game 10. Simplified, the gist of word game 10 is to form individual alphabetical letters 36 by applying letter strip 12 segments to a matrix pattern 22 on a playing surface 40 and to form words from the developed alphabetical letters 36. The object of the game is to complete individual alphabetical letters 36, English, and develop words in competition with other players. Moves are allowed according to the roll of a special die 18. Game parts are described in detail immediately hereafter followed by game instructions and rules.

In FIG. 1, a number of letter strips 12 are shown from exposed strip surface side 14, the side visible when letter strips 12 are attached to matrix patterns 22. Letter strips 12 are elongated rectangular strips having a smooth flat exposed strip surface 14 and a felt material 26 backing. Also see FIG. 5 and FIG. 6. Exposed strip surface 14 can have a distinctive coloring 16 to designate one player's letter strips 12 from another's. The number of letter strips 12 shown in FIG. 1 are for illustration only as players are not restricted to any particular number of letter strips 12 and are allotted letter strips 12 in accordance with a roll of special die 18. In FIG. 2, special die 18 used in this word game is shown. Die 18 is limited to a 1, a 2, or 3 roll as game die 18 has only these three spots oppositely embossed in the die 18 surfaces. Game board 20, a principal element of word game 10 is shown in FIG. 3. Although game board 20 is shown having four matrix patterns 22 in FIG. 3, preferably, game board 20 is supplied with five matrix patterns 22 and the players decide on how many of the matrix patterns 22 to use. The choice is normally made according to the age or skill of the players. No limit is imposed on the number of matrix patterns 22 on a particular game board 20. Actually for younger players, three matrix patterns 22 would be preferred. Four matrix patterns 22 in the playing surface of game board 20 makes the game interesting and not too complex. Additional matrix patterns 22 increase the complexity of the game. Each matrix pattern 22 is comprised of intersecting lines 24 forming triangular patterns with straight border lines 25 on three sides forming a generally rectangular outline 28 having one longer side limited by triangular boarder line 30. Longitudinal bisecting line 32 crosses the center of matrix pattern 22 from a left hand upper corner to a right hand lower corner and extends past bottom straight boarder line 25 a short distance as extended line 34. Extended line 34 is for alphabetical letters 36 which may require digital parts formed below the main matrix pattern 22. Intersecting lines 24, straight border lines 25, longitudinal bisecting line 32, triangular border line 30, and extended line 34 can be used to create any letter of the English alphabet, alphabetical letters 36. With modification, matrix pattern 22 could be used for structuring letters of other alphabets. Alphabetical letters 36 are formed by placing letter strips 12 on the lines in matrix patterns 22 to form individual alphabetical letters 36 as illustrated in FIG. 3. Alphabetical letters 36 "H," "A," and "T" have been formed, shown by dotted lines, and the word "HAT" has been developed in the FIG. 3 illustration.

Figure 4:
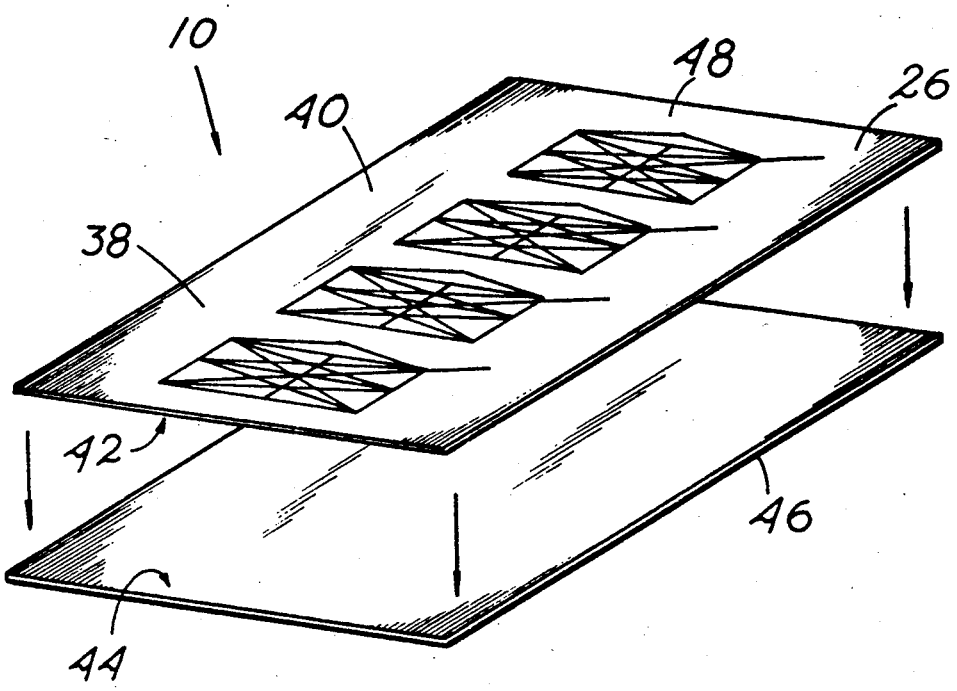
FIG. 4 illustrates a two sectioned game board as structured for this invention. A soft felt finished upper section has a playing surface on top and is illustrated positioned for attachment above a hard base section. The two sections are adhered together and provide the game board element of the present invention.

FIG. 4 illustrates the two section structure of game board 20 which includes game board upper section 38 and game board base section 46. Game board upper section 38 is a layer of felt material 26 the same as is the backing on letter strips 12. Game board upper section 38 has matrix patterns 22 in the top surface which is designated playing surface 40. The underside of game board upper section 38 which is designated upper section attachment surface 42 is permanently adhered to the base attachment upper surface 44 of game board base section 46. When the backing, felt material 26, on letter strips 12 comes in contact with the felt material 26 of game board upper section 38, the two felt materials 26 tend to adhere and letter strips 12 will remain where they are placed on matrix pattern 22 on game board 20. As playing surface 40 is normally flat in a horizontal position when a game is in progress, the adherence between felt material 26 on the playing surface 40 and felt material 26 on the back side of letter strips 12 need be only sufficient to maintain letter strips 12 in position on intersecting lines 24 where they are placed. Although felt material 26 is described as an adhesive material useful in word game 10, adhesion between game board 20 and letter strips 12 can be accomplished in a number of ways using a variety of substrates such as magnetic materials, other fabrics which cling to each other such as optional hook and loop fasteners 48 (see FIG. 4 and FIG. 5), or interlocking pins and apertures for example.

Figure 5:
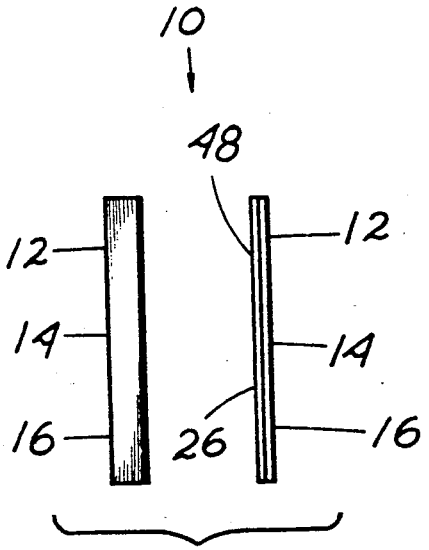
FIG. 5 shows two lettering strip elements of the present invention with one positioned in a full frontal view and the other in an edge view exposing the felt underside common to all the lettering strips provided for this game.
Figure 6:
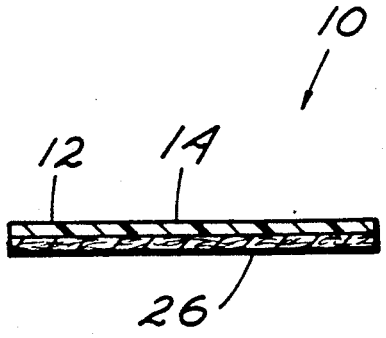
FIG. 6 is an enlarged sectioned end view of a lettering strip used in this game illustrating a hard outer surface which is exposed to view having a soft felt under surface which will remain positioned on the felt playing surface of the game board.

In FIG. 5, two of lettering strips 12 are shown with one in a frontal view and the other in an edge view so felt material 26 backing common to all the lettering strips 12 provided for word game 10 is displayed. The FIG. 6 illustration is an enlarged sectioned end view of a lettering strip 12 which better illustrates the hard outer surface exposed to the player's view and the soft felt material 26 backing under surface which retains letter strips 12 positioned on the felt material 26 playing surface 40 of game board 20.

It is to be noted that word game 10, as the title WORD GAME implies, is primarily adapted as a board game, but would be suitable for use as a computer game programed on a disc or cartridge useful with computer graphics. The game set up and play description which follows includes basic rules primarily applicable to a board game but with some modification could apply to computer usage.

GAME DESCRIPTION AND RULES

Word game 10 may be played by one to five players. Game board 20, whether on a conventional printed board or displayed electronically, uses a unique matrix pattern 22 of intersecting lines 24 on which a player must build an individual English alphabetical letter 36. Each player is supplied with a multiple of identical letter building matrix patterns 22 aligned on playing surface 40 of single game board 20. Each matrix pattern 22 can be used to structure any letter of the alphabet. The matrix patterns 22 are used to build only one alphabetical letter 36 at a time per matrix pattern 22, and the aligned patterns are used to form words. Usually the words are limited to five or fewer letters. Game boards 20, of which each player receives one, are normally provided with five of the letter building matrix patterns 22 on playing surface 40. The players agree at the beginning of the game to build five letter or four letter or three letter words, etc. during a particular playing session and on a winning score or a time period for the game. The letters are built on each matrix pattern 22 using a plurality of elongated narrow letter strips 12. Letter strips 12 are placed on a line 24 of choice on one of the matrix pattern 22 by a player. Felt material 26 on the back of letter strips 12 retain them where positioned by clinging to felt material 26 on playing surface 40 of game board 20. A player manipulates markers only on his board. A single die, special die 18, is rolled twice and tallied by each player at the beginning of the game to determine who starts first. The player with the highest score begins first. Die 18 is then rolled by each player at his turn in order to determine the number of letter strips 12 he may manipulate on that particular turn. For example, if a player rolls the die and gets a 3, he may manipulate three letter strips 12. As previously noted, special die 18 can produce only a 1, 2, or 3 results. His options are to either add up to three letter strips 12 to his matrix patterns 22, subtract up to three letter strips 12 from his matrix patterns 22, to reposition up to three letter strips 12 on his matrix patterns 22, or to manipulate letter strips 12 in any combination he wishes anywhere on his playing surface 40 of his game board 20 where he wishes to form alphabetical letters 36 and ultimately words. The player also has the option to play the entire number of his roll or not play at all.

Scoring is based on one point per alphabetical letter 36 of a formed word. For example, if the players have agreed to form only two letter words, then whenever a player forms a two letter word he receives two points. A player may only score on that particular word one time per game, however other players may score on their board using that same word. After scoring on a word, the player, when his turn comes around again, rolls die 18 and continues to add, subtract, or manipulate letter strips 12 to form more words and score more points. The players play until a player hits a score of 32 or whatever number they have agreed is a winning total. Winning can also be accomplished by the player having the highest score at the end of a certain time period. Players set their own win rules and agree to them prior to beginning the game.

Obviously many variations may be made in the rules of word game 10 according to the invention, however the above rules have been found to be easily followed and to make word game 10 of this invention enjoyable to play.

In the foregoing specifications and the included drawings, I have described word game 10, the subject invention, with considerable details and pictured it extensively in the drawings. However, the descriptions and drawings provided are not meant to limit the invention to a particular form and modifications may be incorporated into the game structure and playing method so long as modifications made remain within the intended scope of the appended claims.

What I claim as my invention is:

1. A word game apparatus comprising:

a game board having at least one flat horizontal surface with at least one ordered matrix pattern affixed on said surface; said matrix pattern produced by a series of connecting lines forming triangle shapes with said connecting lines adapted to provide guidance for structuring letters of a specified alphabet;

a plurality of rectangular elongated uniform strips sized to fit at least a half portion of any said connecting lines;

means for temporary adherence of said uniform strips to said at least one flat horizontal surface of said game board and along said connecting lines producing said matrix patterns;

means for randomly generating numerical information effecting player-agreed use options for disposition of said strips relative to said matrix patterns and for advancing said game to a win conclusion.

2. The word game apparatus of claim 1 wherein said means for temporary adherence of said uniform strips to said at least one flat horizontal surface of said game board and along said connecting lines producing said matrix patterns includes said uniform strips having a wide side affixed with a fabric material which clings to a fabric material affixed to said flat horizontal surface of said game board including any said matrix patterns thereon.

3. The word game apparatus of claim 2 wherein said fabric material on said strip which clings to said fabric material on said horizontal surface of said game board includes felt.

4. The word game apparatus of claim 2 wherein said fabric material on said strip which clings to said fabric material on said horizontal surface of said game board includes hook and loop fabric fasteners.

5. The word game apparatus of claim 1 wherein said means for randomly generating numerical information effecting player-agreed use options for disposition of said strips relative to said matrix patterns and for advancing said game to a win conclusion includes a die having opposite surfaces embossed with duplicate numbers of dots producing random totals of 1, 2, and 3 when said die is thrown.

6. A word game apparatus comprising:

a game board having a playing surface, said playing surface having a plurality of matrix patterns thereon; said plurality of matrix patterns each structured of a series of lines providing triangular shapes, said lines adapted to provide guidance for structuring letters of a specified alphabet by a player;

a plurality of rectangular marker strips structured for placement on said lines by said player, said marker strips when placed on said lines adapted to allow formation of said letters of said specific alphabet using a plurality of said markers strips to structure a single letter of said letters;

means adapted to provide randomly generated information determining a number of allowed placements of said marker strips onto said lines by said player per turn in said word game;

said plurality of matrix patterns further adapted to allow formation of a word structured of said letters using said marker strips placed on said lines.

* * * * *